US012808210B2

(12) United States Patent
Gordon et al.

(10) Patent No.: US 12,808,210 B2
(45) Date of Patent: Nov. 24, 2026

(54) MAST CLIMBING WORK PLATFORM WITH TRANSLATING FUNCTION AND RELATED METHOD

(71) Applicant: Klimer Platforms Inc., Milton (CA)

(72) Inventors: James Gordon, Milton (CA); Ihton Frederick, Milton (CA); Jeff Murray, Milton (CA)

(73) Assignee: Klimer Platforms Inc., Milton (CA)

( * ) Notice: Subject to any disclaimer, the term of this patent is extended or adjusted under 35 U.S.C. 154(b) by 351 days.

(21) Appl. No.: 18/405,406

(22) Filed: Jan. 5, 2024

(65) Prior Publication Data

US 2025/0223816 A1 Jul. 10, 2025

(51) Int. Cl.

| | |
|---|---|
| ***E04G 1/18*** | (2006.01) |
| ***E04G 1/24*** | (2006.01) |
| ***E04G 1/38*** | (2006.01) |
| ***E04G 5/00*** | (2006.01) |

(52) U.S. Cl.

CPC ..... *E04G 1/18* (2013.01); *E04G 1/24* (2013.01); *E04G 1/38* (2013.01); *E04G 5/006* (2013.01); *E04G 2001/242* (2013.01)

(58) Field of Classification Search

CPC .... E04G 1/18; E04G 1/20; E04G 1/24; E04G 2001/157; E04G 5/006; E04G 3/246; E04G 2001/242

USPC ..... 182/129

See application file for complete search history.

(56) References Cited

U.S. PATENT DOCUMENTS

| | | | | | |
|---|---|---|---|---|---|
| 4,809,814 | A * | 3/1989 | St-Germain | E04G 1/20 | 182/132 |
| 5,067,587 | A * | 11/1991 | Mims, Jr. | B66F 11/04 | 182/69.6 |
| 5,381,872 | A * | 1/1995 | Peruzzi | E04G 1/18 | 182/63.1 |
| 6,186,273 | B1 * | 2/2001 | Goldbach | B24C 3/062 | 182/128 |
| 7,448,470 | B2 * | 11/2008 | Brown | B66F 11/042 | 182/69.5 |
| 8,051,951 | B2 * | 11/2011 | Bennett | B61K 13/00 | 182/132 |
| 9,550,661 | B2 * | 1/2017 | St-Germain | E04G 1/20 | |
| 10,858,893 | B2 * | 12/2020 | Toma | E21B 41/00 | |
| 2002/0170784 | A1 * | 11/2002 | Duplessis | E04G 1/20 | 187/242 |
| 2005/0056484 | A1 * | 3/2005 | Fredette | B66F 11/04 | 182/62.5 |
| 2007/0193831 | A1 * | 8/2007 | Vance | B66F 7/12 | 182/141 |

(Continued)

*Primary Examiner* — Brian E Glessner

(74) *Attorney, Agent, or Firm* — Maier & Maier, PLLC

(57) ABSTRACT

In one or more embodiments a mast climbing work structure may be provided. The mast climbing work structure may include a base structure and a mast attached to the base structure and rising vertically from the base structure. The mast climbing work structure may further include a work platform attached to the mast. The work platform may have a deck a structural frame underneath the deck and at least one side platform connected to a side of the structural frame. The work platform may be configured to ascend and descend via the vertical mast and the side platform may be configured to raise vertically and translate alongside the side of the structural frame.

11 Claims, 7 Drawing Sheets

(56) References Cited

U.S. PATENT DOCUMENTS

| | | | | |
|---|---|---|---|---|
| 2010/0175951 | A1* | 7/2010 | Winson | E04G 3/24 182/116 |
| 2012/0025507 | A1* | 2/2012 | Berry, Jr. | E04G 3/00 280/769 |
| 2019/0161980 | A1* | 5/2019 | Walker, II | E04G 1/24 |
| 2021/0362980 | A1* | 11/2021 | Barker | B66B 9/187 |

* cited by examiner

MAST CLIMBING WORK PLATFORM WITH TRANSLATING FUNCTION AND RELATED METHOD

BACKGROUND

Mast Climbing Work Platforms (MCWP) are powered scaffolding systems used in construction and maintenance applications to provide access to work areas at height. The platforms may be modular and may be configured to fit various lengths and heights as required by the project in question. Existing structures may be a single mast system, or a double mast system for increased platform size and weight capacity.

The work platform may travel vertically up and down the mast in order to reach different locations on a building or other work site. Platforms equipped with existing technology may have difficulty navigating certain types of structures, for example where there exist obstructions. Additionally, platforms may have difficulty working on, for example, beams or other building components that may extend outward from the building.

SUMMARY

In one or more embodiments a mast climbing work platform structure may be provided. The mast climbing work platform structure may include a base structure and a mast attached to the base structure and rising vertically from the base structure. The mast climbing work platform structure may further include a work platform attached to the mast. The work platform may have a deck a structural frame underneath the deck and at least one side platform connected to a side of the structural frame. The work platform may be configured to ascend and descend via the vertical mast and the side platform may be configured to raise vertically and translate alongside the side of the structural frame.

BRIEF DESCRIPTION OF THE FIGURES

Advantages of embodiments of the present invention will be apparent from the following detailed description of the exemplary embodiments. The following detailed description should be considered in conjunction with the accompanying figures in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

In one or more exemplary embodiments a Mast Climbing Work Platform (MCWP) may be shown and described.

Figure 1A:
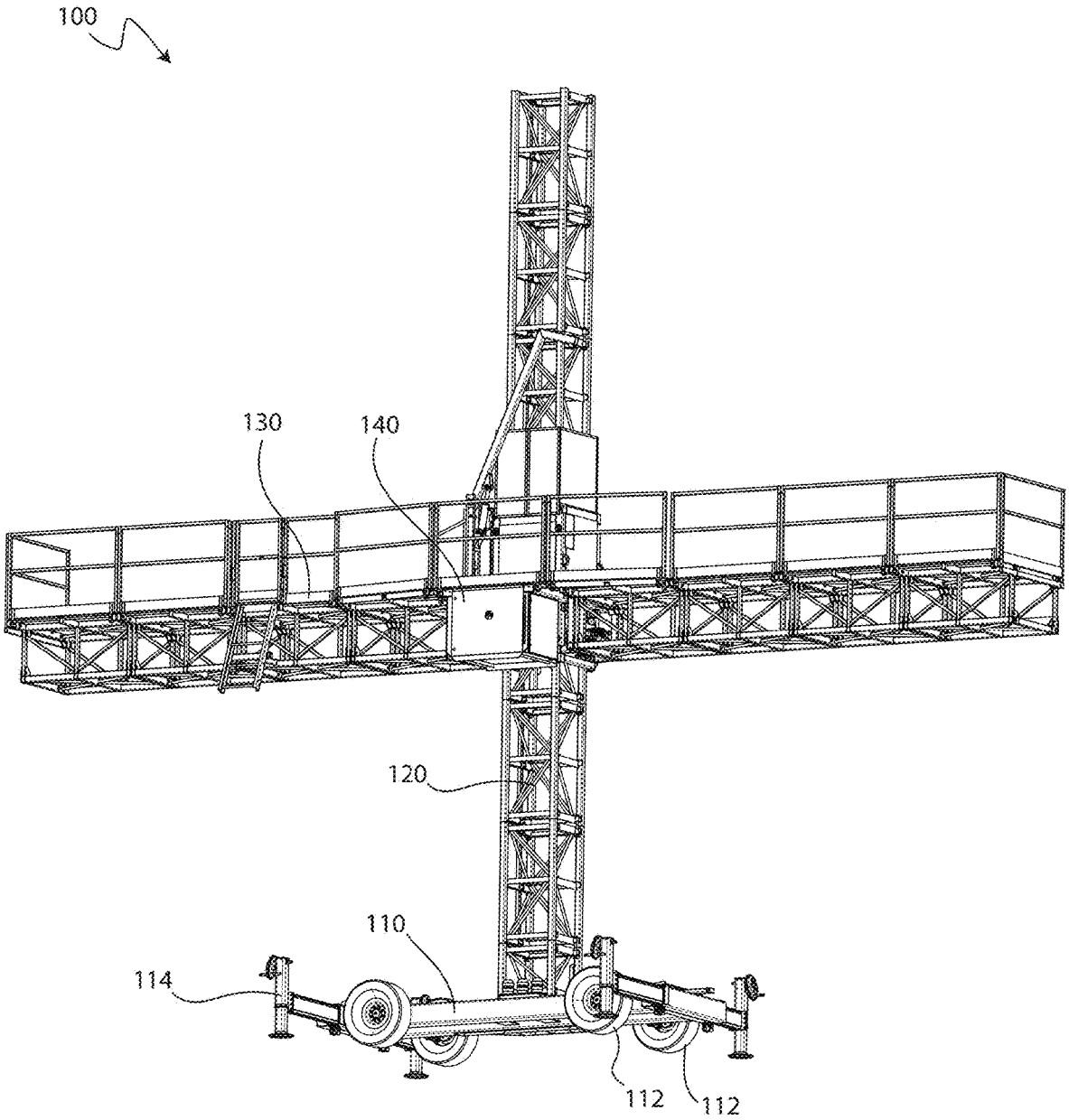
FIG. 1A shows an exemplary mast climbing work platform.

Referring to FIG. 1A, an exemplary MCWP 100 may be shown and described. The MCWP 100 may include a base structure 110, which may carry and support the MCWP 100. The base structure 110 may have movement means 112, for example wheels or treads. The movement means 112 may allow for the entire MCWP 100 to be moved from location to location. The base structure 110 may further have one or more stability structures 114, which may lock the MCWP 100 in place during use. The stability structure may include, for example, jacks or locks that prevent the movement means 112 from moving and/or lift the base structure 100 off the ground.

A mast 120 may rise vertically from the base structure 110. The mast 120 may be any height, for example, in some embodiments 200 meters or more in height. In some embodiments the mast 120 may be made of, for example, 350 W HSS members, and may further include a vertical linear rack. The mast 120 may be connected to the base structure 110 via, for example, one or more mast bolts. A work platform 130 may be attached to the mast 120. In some embodiments the work platform 130 may be between 3 meters and 17 meters long. In other embodiments the work platform may be a different length, e.g. 1 meter, 1.5 meters, 20 meters, etc. The work platform 130 may be configured to ascend or descend via the mast 120 through the use of, for example, a motor and/or hydraulic pistons. For example, in an exemplary embodiment, the work platform 130 may be connected to the mast 120 via a platform system drive unit. The drive unit may contain, for example, a rack and pinion drive system to propel the drive unit and connected platform up or down the mast. In some embodiments the drive unit may be supported by two or more drive motors, which may further be attached to the drive shaft via a pinion. The drive motors may be any kind of motor known in the art, for example electric motors and/or hydraulic motors.

In some embodiments the work platform 130 may ascend or descend at speeds up to, for example, 39 feet per minute. In some embodiments the MCWP may include a drive train 140 with one or more power sources, for example one or more primary engines may be located on the drive unit. The drive train 140 may connect the work platform 130 to the mast 120. In some embodiments an additional emergency engine may be located on or near the work platform, for example under an emergency hatch built into the work platform. The emergency engine may allow for a limited number of actions, for example being restricted to allowing the platform to descend in situations where the main power source fails or otherwise has issues.

In some embodiments the MCWP may be a twin mast system, that is the work platform may be attached to two separate mast structures. It may be understood that in a twin mast system the work platform may be larger, for example up to 40 meters in length. In other embodiments the MCWP may be a twin corner mast, where the twin masts are arranged perpendicular to each other, which may be used to service, for example, a building corner or other non-linear structure.

Figure 1B:
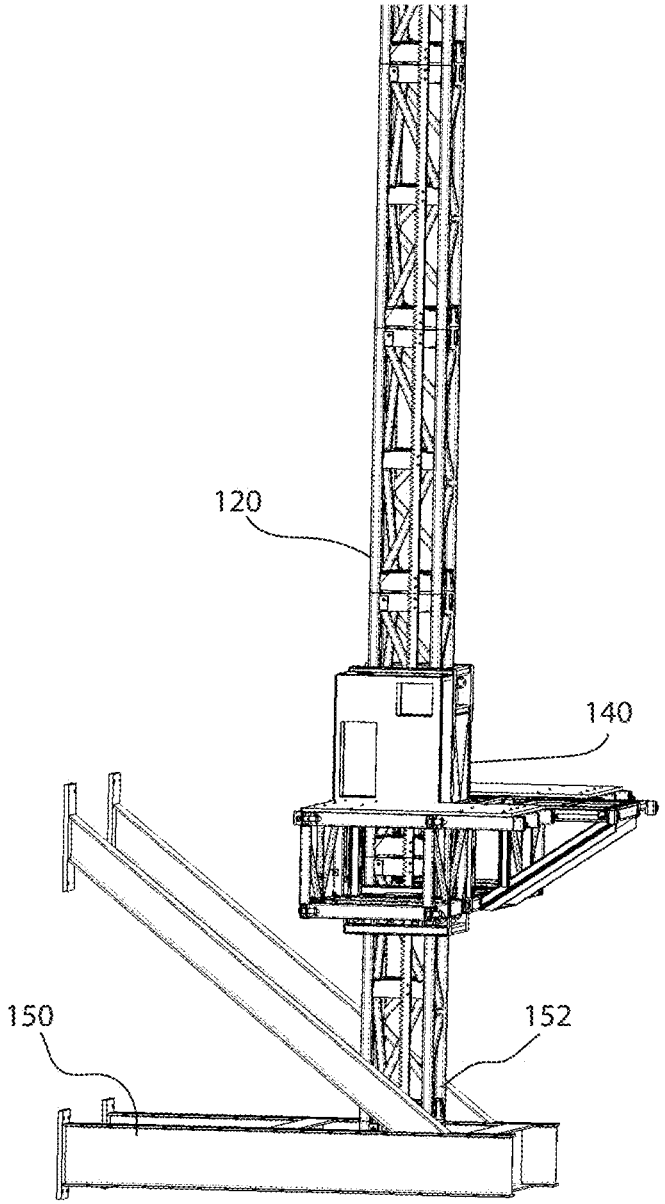
FIG. 1B shows another exemplary mast climbing work platform with a pedestal base.

Referring to FIG. 1B, an alternative MCWP with a pedestal type base 150 may be shown and described. In some embodiments the pedestal type base 150 may be site specific, and may be, for example, bolted to a building or another structure. The MCWP may include a base plate 152 which may secure the mast 120 to the pedestal base 150.

Figure 2A:
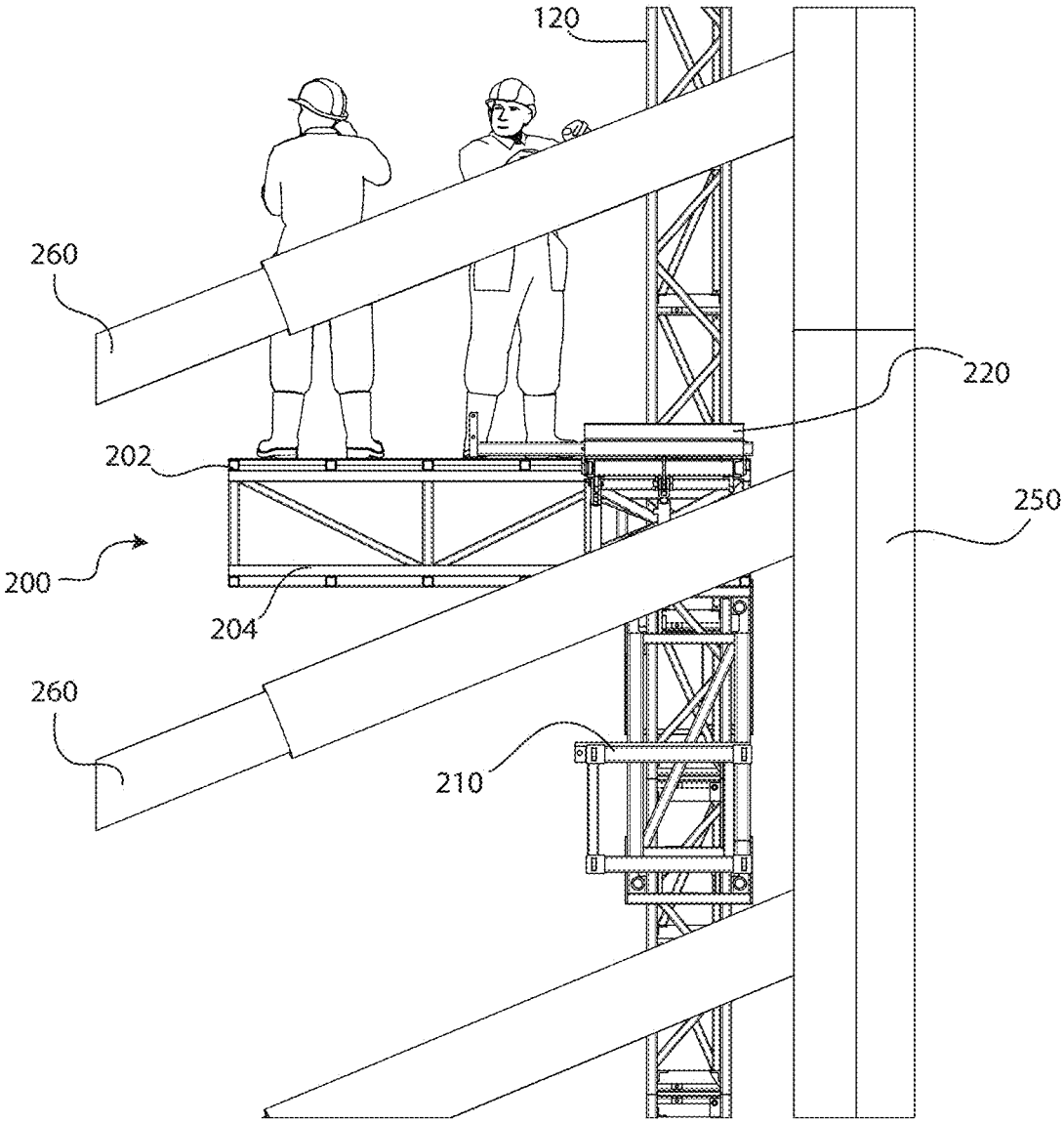
FIG. 2A shows an exemplary work platform with translating function.
Figure 2B:
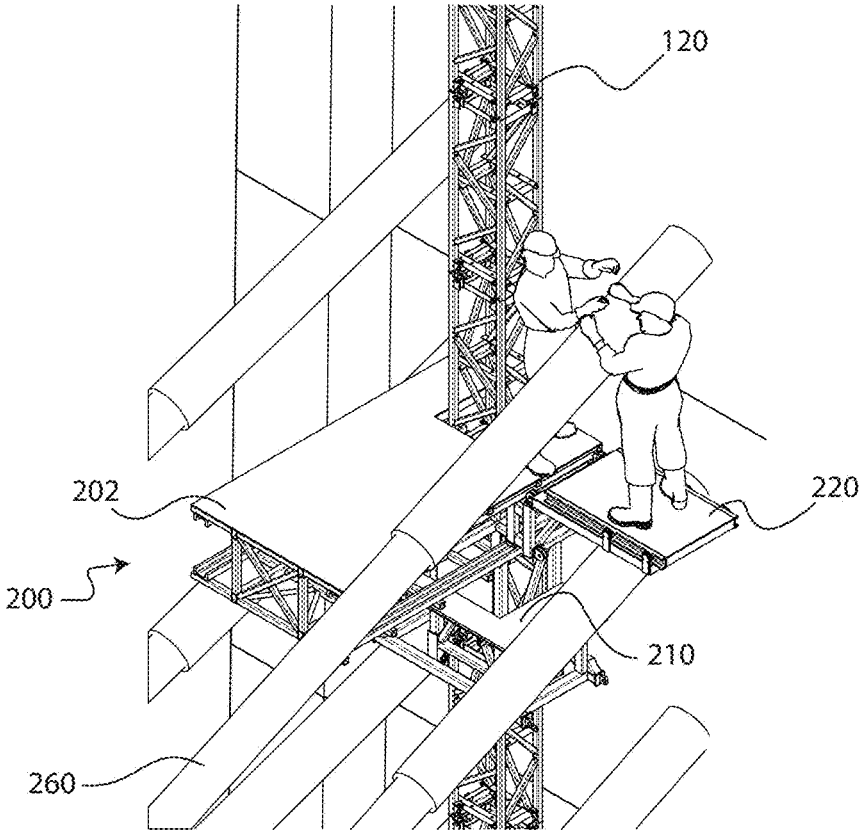
FIG. 2B shows another exemplary work platform with translating function.
Figure 2C:
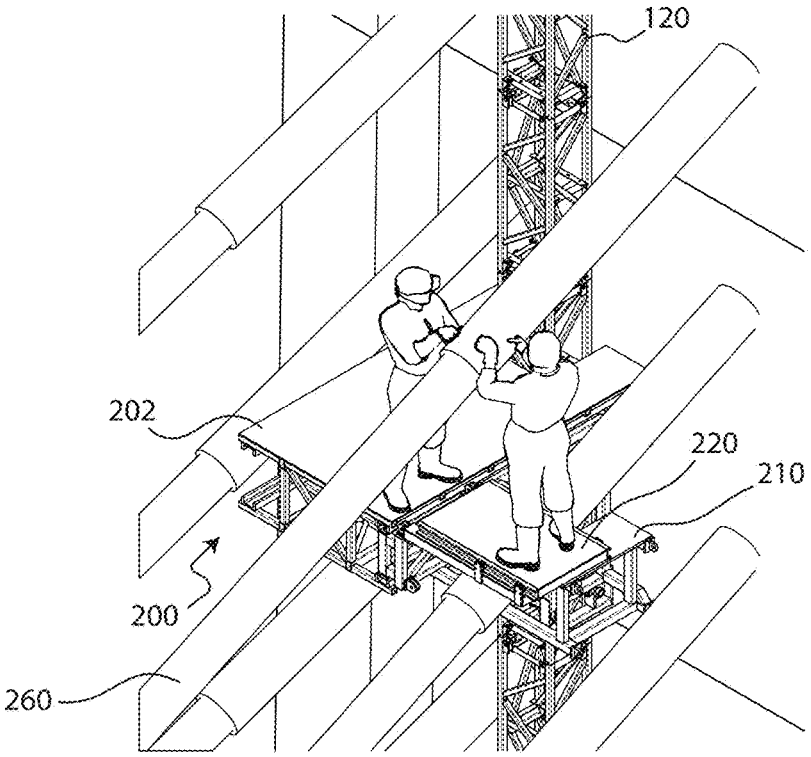
FIG. 2C shows another exemplary work platform with translating function.

Referring now to FIGS. 2A-2C, an exemplary work platform with translating function 200 may be shown and described. The work platform 200 may have a deck 202, and a structural steel frame 204. In other embodiments the frame 204 may instead be, for example, one or more of aluminum and stainless steel, and the deck 202 may be, for example, one or more of planks, plywood, fiber glass, steel plate, steel mesh, steel grating, extruded plastic, and/or fiber reinforced plastic. The structural steel frame 204 may be configured to support multiple structural loads, for example shear, bending, and torsional forces, generated by the work platform 200 and/or one or more side platforms 220. The work platform 200 may be attached to the mast 120 via a drive unit 210. The forces supported by the structural steel frame 204 may be transferred to the drive unit by the structural steel frame 204.

The work platform 200 may further have the one or more side platforms 220. For example, in an embodiment there may be a side platform extending out from each of a left side and a right side of the work platform 200 so that the side platforms 220 are parallel to a work structure 250. In other embodiments there may be a different number of side platforms 220, and/or they may extend out a different direction relative to the work structure 250. The work structure 250 may further have one or more obstacles 260 or additional structures extending outward from the work structure 250 in the direction of the work platform 200. The obstacles 260 may be, for example, structural beams, wiring, cables, pipe structures, broken portions of the building, or any other obstacle.

In some embodiments the work platform 200 may have a control panel with controls for the work platform and side platform. The control panel may include, for example, an Auxiliary box and drive box for enabling travel of the work platform up and down the mast and/or for controlling operation of, for example, the side platform. In an embodiment, the drive box may include a plurality of switches, knobs, or levers which may be used to control individual operations, for example a first lever may control ascent and descent of the work platform, a second lever may control extension of the side platform, etc.

As shown in FIG. 2A, the side platforms 220 may be configured to fold to a vertical position. For example, when the work platform 200 is ascending or descending via the mast 120, the side platforms 220 may be folded into a vertical position in order to avoid one or more obstacles 260. As shown in FIGS. 2B-2C the side platforms 220 may further be configured to translate along a side of the work platform 200. The translating may be done while the side platforms 220 are either vertical or horizontal. The side platform may be able to reach any portion of the side of the work platform 200 and may be locked in place at any location. The drive unit 210 may provide power to the work platform and enable various functions for example the folding or translating functions. The work platform 200 may include one or more of hydraulic or pneumatic cylinders, hydraulic or pneumatic or electric motors, chains, drive sprockets, and/or idler sprockets. For example, in an exemplary embodiment, the work platform may include a hydraulic or pneumatic cylinders, hydraulic or pneumatic or electric motors, chain, a drive sprocket, and 2 idler sprockets, which may work in conjunction to power the vertical folding and translating functions.

Figure 3A:
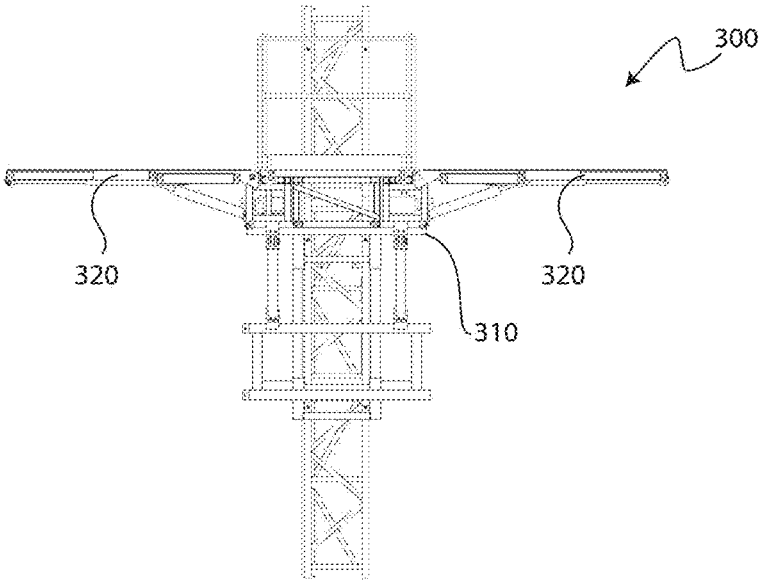
FIG. 3A shows an exemplary side platform construction.
Figure 3B:
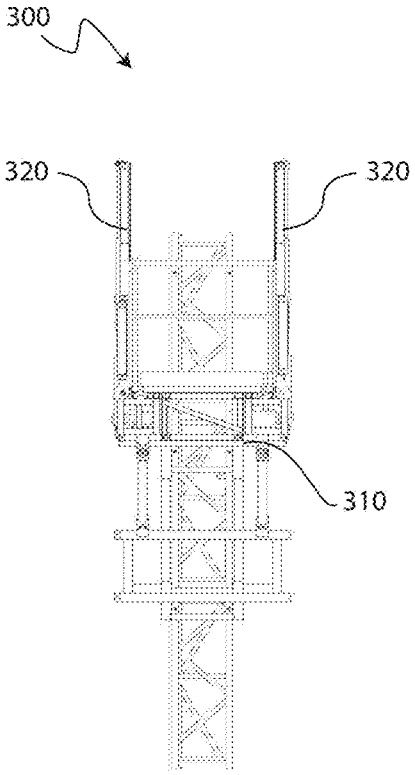
FIG. 3B shows another exemplary side platform construction.
Figure 3C:
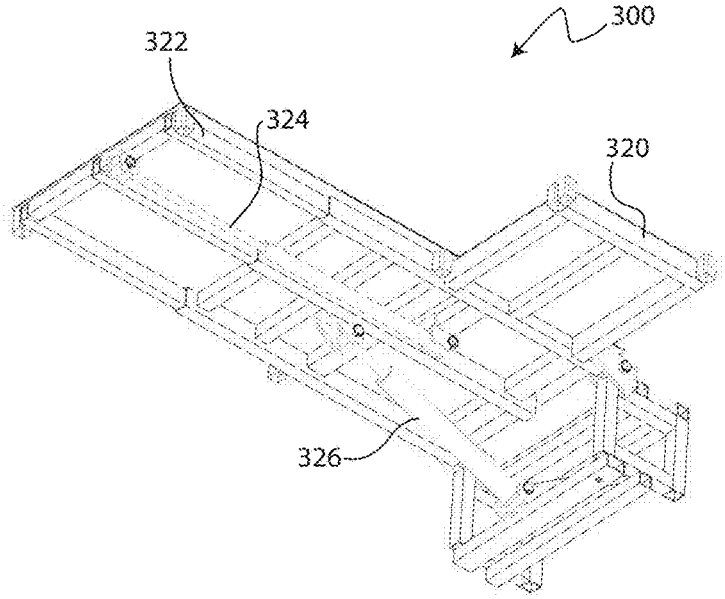
FIG. 3C shows an under view of an exemplary side platform construction.

Referring to FIGS. 3A-3C, exemplary side platform constructions 300 may be shown and described. The side platform construction may include a side platform 320 connected a work platform 310 or drive unit. The side platform 320 may have an extendible portion 322, which may be configured to extend outward via, for example, a motor, actuator, or piston 324. A second motor, actuator, or piston 326 may be configured to fold the side platform 320 vertically. The motor, actuator, or pistons 324 and 326 may be powered via, for example, hydraulics or pneumatics. In an exemplary embodiment the pistons 324 and 326 may be powered by hydraulic oil from the drive unit. In some embodiments one or more pistons may be activated independently and/or simultaneously.

Figure 4A:
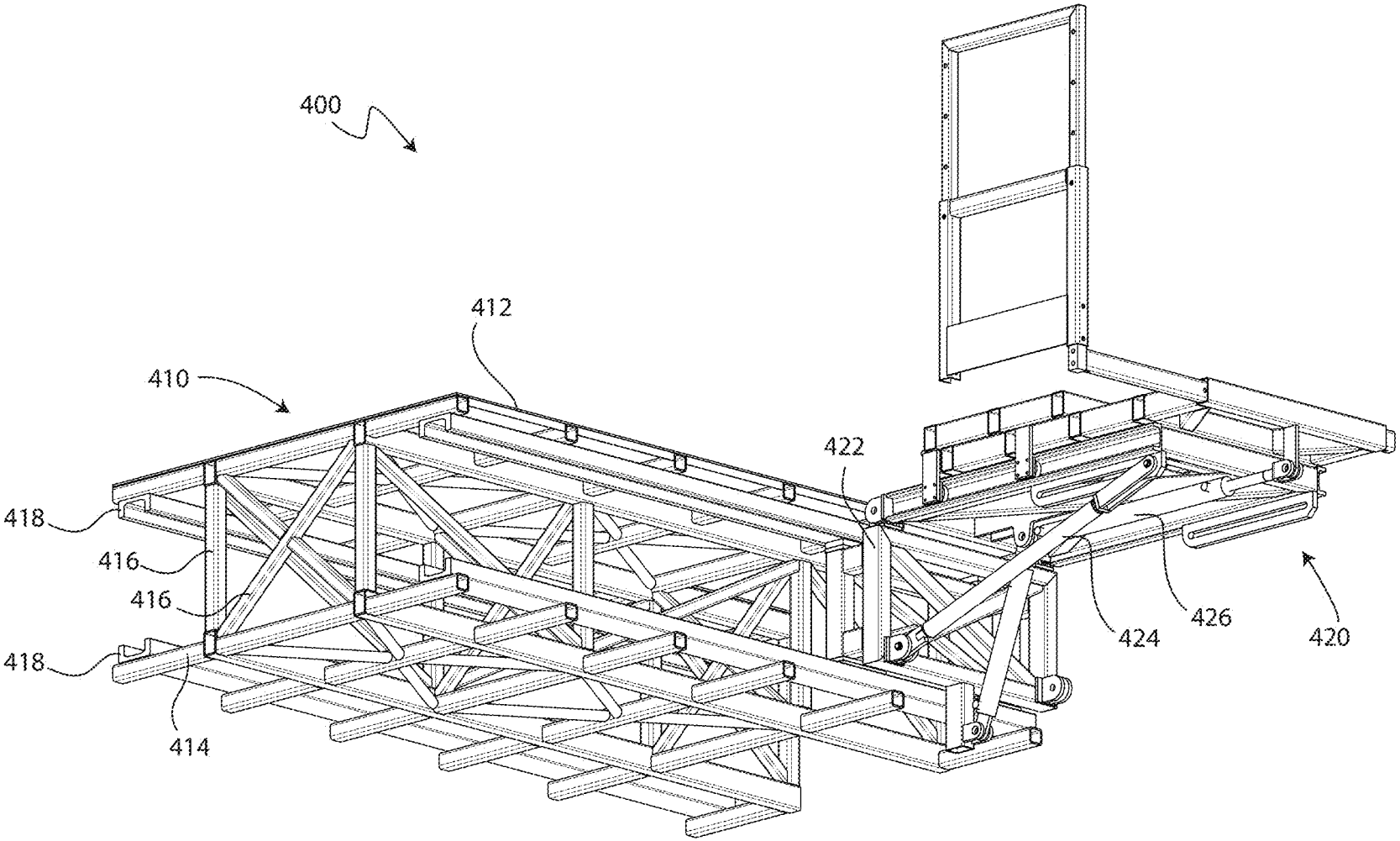
FIG. 4A shows another exemplary side platform construction with translating function.
Figure 4B:
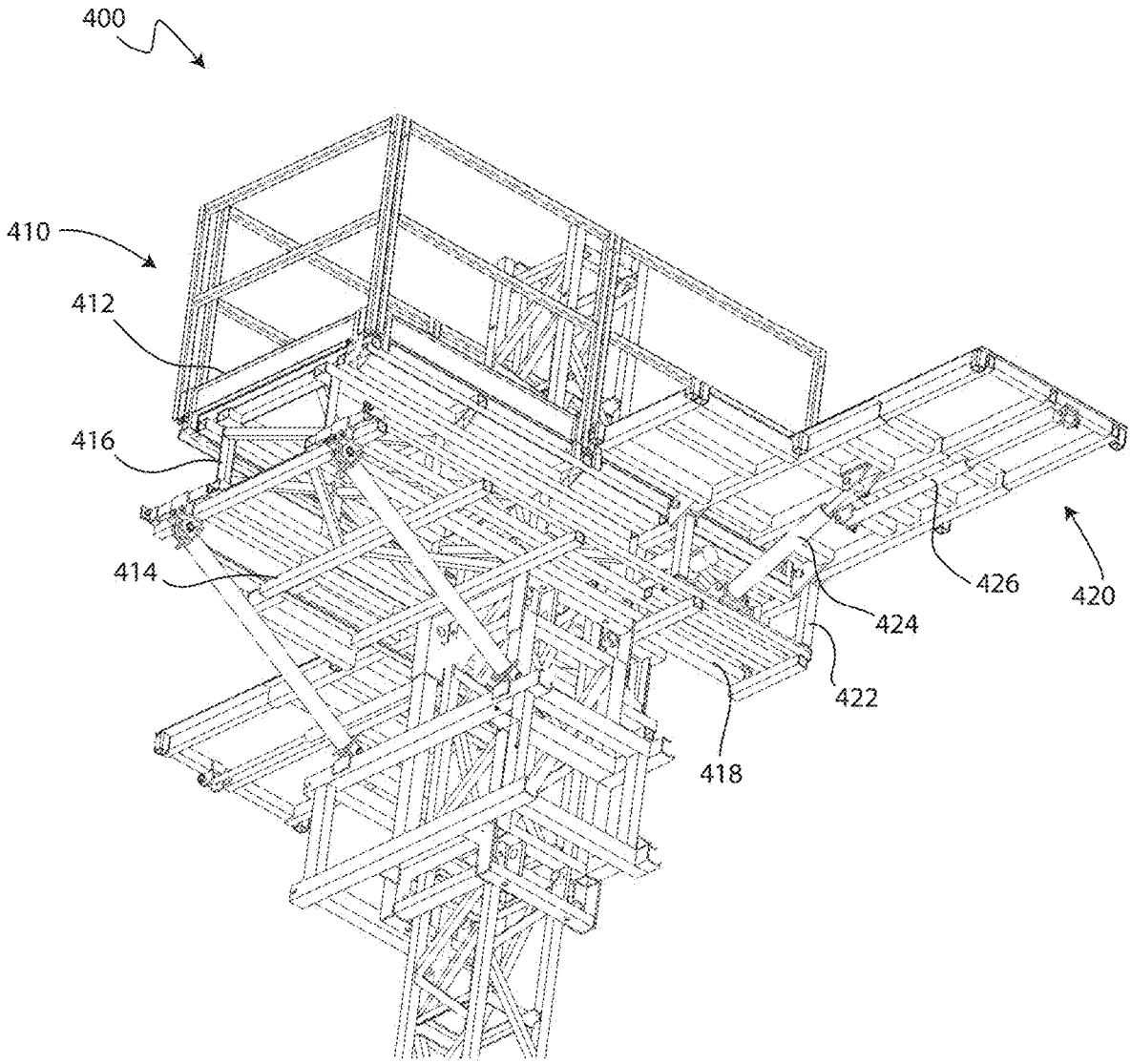
FIG. 4B shows an under view of another exemplary side platform construction with translating function.

Referring to FIG. 4A-4B, another exemplary side platform construction with translating function 400 may be shown and described. The exemplary construction 400 may have a work platform 410. The work platform 410 may have an upper deck 412, which may be made of, for example, high density plywood, steel plates, checker plate, and/or slats of steel. The work platform 410 may further have an underside platform 414. A support structure 416, which may be, for example, a latticework of steel beams, may connect the upper deck 412 and the underside platform 414. The support structure 416 may further provide additional support for the work platform 410. A carriage support structure 418 may be connected underneath the upper deck 412 and/or above the underside platform 414 on one or more sides of the work platform 410.

The exemplary construction 400 may further have a side platform 420, which may be connected to the work platform 410 via a carriage 422. The carriage 422 may have an inner and outer section with cross beam supports and may be configured to fit between the carriage support structure 418. The carriage 422 may be able to slide along the carriage support structure 418, which may be understood to cause the side platform 420 to translate along the side of the work platform 410. The side platform 420 may further have one or more motors, actuators, pistons, and/or hydraulic or pneumatic cylinders. for example, a first cylinder 424 may be configured to fold the side platform 420, and a second piston 426 may be configured to extend the side platform 420 outward from the work platform 410.

In some embodiments the translating, folding, and extending functions may be controlled by a control mechanism, for example levers, buttons, remotes, etc. for example, in an exemplary embodiment there may be a control panel on the work platform 410, which may include a lever for each function, e.g. a first lever that folds or lowers the platform, a second lever that translates the platform toward or away from the building, and/or a third lever that extends or retracts the platform length.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A mast climbing work platform structure comprising:

a base structure;

a mast attached to the base structure and rising vertically from the base structure; and a work platform attached to the mast, the work platform further comprising;

a deck;

a structural frame underneath the deck; and at least one side platform connected to a side of the structural frame;

wherein the work platform is configured to ascend and descend via the vertical mast;

the side platform is configured to raise vertically and translate alongside the side of the structural frame;

the structural frame underneath the deck further comprises at least a carriage support and a carriage;

the carriage is connected to the at least one side platform and the carriage support; and the at least one side platform is configured to translate along the carriage support via the carriage.

2. The mast climbing work platform structure of claim 1, wherein the base structure, mast, and work platform are comprised of at least steel.

3. The mast climbing work platform structure of claim 1, wherein the one or more side platforms further comprises an extendable portion, which may extend outward from the work platform to increase the length of one or more side platforms.

4. The mast climbing work platform of claim 1, wherein the drive unit further comprises at least two drive motors, attached to the drive shaft via one or more pinions.

5. The mast climbing work platform of claim 4, wherein the drive motors are electric and/or hydraulic motors.

6. The mast climbing work platform of claim 1, wherein the base structure further comprises at least a stability structure configured to secure the base.

7. The mast climbing work platform of claim 6, wherein the stability structure includes at least movement means.

8. The mast climbing work platform of claim 6, wherein the base structure is configured to attach to a building or a work surface.

9. The mast climbing work platform of claim 1, wherein the work platform further includes at least an emergency hatch and an emergency engine, wherein the emergency engine is contained under the emergency hatch; and the emergency engine is configured to provide power to the drive unit.

10. The mast climbing work platform of claim 9, wherein the emergency engine is configured to power the drive train to descend the work platform in emergency scenarios.

11. The mast climbing work platform of claim 10, wherein the emergency scenario is damage or loss of power to a primary hydraulic power unit.

* * * * *